US009975683B2

(12) United States Patent
Davis et al.

(10) Patent No.: US 9,975,683 B2
(45) Date of Patent: May 22, 2018

(54) CAP WITH ADDITIVE CHAMBER AND ASSOCIATED PACKAGING UNIT

(75) Inventors: Jeffrey Martin Davis, Maidenhead (GB); Helen Marie Moore, Sandwich (GB)

(73) Assignee: Wyeth LLC, New York, NY (US)

( * ) Notice: Subject to any disclaimer, the term of this patent is extended or adjusted under 35 U.S.C. 154(b) by 156 days.

(21) Appl. No.: 14/007,631

(22) PCT Filed: Mar. 22, 2012

(86) PCT No.: PCT/IB2012/051381
§ 371 (c)(1),
(2), (4) Date: Nov. 25, 2014

(87) PCT Pub. No.: WO2012/137091
PCT Pub. Date: Oct. 11, 2012

(65) Prior Publication Data

US 2015/0076012 A1 Mar. 19, 2015

Related U.S. Application Data

(60) Provisional application No. 61/471,818, filed on Apr. 5, 2011.

(51) Int. Cl.
*B65D 25/08* (2006.01)
*B65D 81/32* (2006.01)
(Continued)

(52) U.S. Cl.
CPC ..... *B65D 81/32* (2013.01); *B65D 51/22* (2013.01); *B65D 51/28* (2013.01); *B65D 51/2835* (2013.01)

(58) Field of Classification Search
CPC ..... B65D 45/16; B65D 45/18; B65D 45/30; B65D 81/3211; B65D 51/2835;
(Continued)

(56) References Cited

U.S. PATENT DOCUMENTS 3,347,410 A * 10/1967 Schwartzman ..... A45D 19/02 206/222
4,103,772 A * 8/1978 Wiegner ..... B65D 81/3211 206/222
(Continued)

FOREIGN PATENT DOCUMENTS

| | | |
|---|---|---|
| EP | 0373016 | 6/1990 |
| EP | 1623932 | 2/2006 |
| WO | WO2006123946 | 11/2006 |

*Primary Examiner* — J. Gregory Pickett
*Assistant Examiner* — Rafael Ortiz
(74) *Attorney, Agent, or Firm* — Jeffrey M. Gold; Michael R. Crabb

(57) ABSTRACT

The present invention comprises a cap (101) having a chamber and a packaging unit having this cap (101) attached to a container. A membrane (405) separates the chamber in the cap from a reservoir in the container, so that two different components may be kept separate until ready to use. The cap (101) has a collapsible (102) button with a piercing element so that when the button (102) is pressed the membrane (405) is pierced and the contents of the chamber and reservoir may be mixed together.

13 Claims, 7 Drawing Sheets

(51) Int. Cl.
*B65D 51/28* (2006.01)
*B65D 51/22* (2006.01)

(58) Field of Classification Search
CPC ..... B65D 81/32; B65D 51/22; B65D 51/28; B65D 25/08
USPC ..... 206/222, 219; 222/80, 92, 93, 103, 222/153.01, 153.02, 153.04, 153.14; 215/245
See application file for complete search history.

(56) References Cited

U.S. PATENT DOCUMENTS

| | | | | |
|---|---|---|---|---|
| 4,412,623 | A * | 11/1983 | Schmidt | A61J 9/00 215/11.1 |
| 6,165,523 | A | 12/2000 | Story | |
| 6,250,505 | B1 * | 6/2001 | Petit | B65D 83/0077 222/105 |
| 7,175,049 | B2 * | 2/2007 | Kastenschmidt | B65D 51/226 206/219 |
| 9,126,731 | B2 | 9/2015 | Chen | |
| 2002/0030056 | A1 * | 3/2002 | Hsu | B65D 81/3211 220/505 |
| 2002/0053524 | A1 | 5/2002 | Alticosalian | |
| 2006/0219736 | A1 | 10/2006 | Revenu | |
| 2007/0199838 | A1 * | 8/2007 | Oh | B65D 81/3222 206/219 |
| 2010/0012660 | A1 | 1/2010 | Morini et al. | |
| 2010/0078438 | A1 | 4/2010 | Lee et al. | |
| 2010/0187257 | A1 * | 7/2010 | Roth | B65D 47/243 222/129 |
| 2013/0105433 | A1 | 5/2013 | Chen | |

* cited by examiner

CAP WITH ADDITIVE CHAMBER AND ASSOCIATED PACKAGING UNIT

BACKGROUND OF THE DISCLOSURE

This invention relates to a packaging unit containing two different compositions to be mixed together before use, which includes a cap having a chamber for holding one composition, a container holding another composition, and a membrane separating the two compositions, where the cap is configured to facilitate breaking or piercing the membrane to allow the two compositions to mix.

Biphase products are those in which the product is supplied as two separate components, frequently a liquid and a powder but also liquid-liquid and paste-paste combinations, in packaging which allows the components to be kept separate until the time of use The need to keep the components separate arises for a number of reasons, but usually because their interaction would reduce the quality of one or the other, or because some interaction essential to product functioning occurs over a short timeframe and must not be initiated prematurely.

There are many designs of packaging which perform the function of keeping the components separate, yet permits their mixing within the pack. For example, one compartment of the packaging is configured as a chamber within the cap of a container, and it may also incorporate some form of applicator or dispense feature.

Common means by which the components are combined within the packaging are by the breaking of a frangible membrane or peelable seal. Of the designs in commercial use, many are activated by the consumer pressing a button, which in turn breaks the frangible membrane. In other examples, its pressing causes orifices between the chambers of the packaging to be aligned. The button is generally configured as a piston operating within a barrel.

The packaging should keep the components of the two chambers not only physically separate, but also prevent any volatile components from permeating through the membrane or seal into the other compartment. Also, the components may need protection from the atmosphere external to the packaging. It follows that the interference fit between the button, and the barrel, and the nature of the interface between the chambers should be as secure as possible. One consequence of this is that the force needed to depress the button is often higher than acceptable to the target user group for the product This can be exacerbated by product causing friction between the parts.

In some designs using aluminum foil as a frangible membrane, the product chamber within the cap is configured as a conventional blister, particularly if the component to be contained within is a tablet. However, such designs require the additional step of blister packing prior to inserting the blister into the cap, use a greater number of different materials, and the blister is without features to cause its collapse. In some of these the foil face of the blister is used to seal to the rim of the container that comprises the second chamber. Being a hard surface and lacking a resilient design feature this seat may not fully accommodate variations in the container rim or backing-off of the application torque, and prove insecure.

In several designs of such packaging, the button is associated with a screw thread, such that the mechanical advantage of the screwing action substantially reduces the effort required of the user. The action of joining the compartments is most frequently that a cap is further tightened, or only partially unscrewed, prior to full opening. Such action, and the pause whilst the components of the product mix together, is counterintuitive for many users, and misuse may result in reduced product performance.

Moreover, the means of filling the product components into the packaging should be considered. It is generally preferable to avoid multiple steps in the filling and assembly of the cap components at the site of product manufacture, or that filling and assembly at a different location with specialist equipment is necessary. In commercial units, the product chamber within the cap is frequently a simple two piece construction in which one piece is filled and the other is pressed on to it, in the manner of filling a small container. This sub-assembly is also fitted to the body of the main container in a conventional manner.

The complexity of supply of packaging components, and their ultimate disposal, should also be considered. It is always preferable to reduce the number of components and materials used.

US 2010076438A describes a cap assembly with a storage chamber for a secondary material. which is separated from a primary material below the cap by a seal. When the cap is turned the seal is moved out of the way and the secondary material may mix with the primary material.

US 2006219736A describes a device for placing in contact at least two products packaged separately in two compartments. The first compartment is within a container and the second is at least partially within a body attached to the container by an intermediate part. An actuating action changes the position of the body relative to the container and places the two compartments in communication with each other.

EP1623932A describes a device having a reservoir-containing capsule attached to a container and a breaking means actuated with pressure from the top, where said capsule, breaking means and reservoir are made of a single body.

US 2010012660A describes a capsule having a reservoir attached to the top of a container, wherein the capsule has an obstructor which separates the reservoir contents from the container until the obstructor is extracted.

US 2002053524A describes a cap for storing powder and releasing it into a bottle. The cap has a cap top and an inner member that fits partially into the cap top to form a cavity to hold powder, and the cap is secured over the neck of the bottle. When the cap is rotated, the cap top is raised relative to the inner membrane so as to open the chamber.

SUMMARY OF THE INVENTION

The present invention comprises a cap comprising a collapsible button defining a chamber therein, the cap having an opening at the bottom. A membrane securely covers the opening to seal in the contents of the chamber. The collapsible button has a piercing member on its inner surface disposed to pierce the membrane when sufficient inward pressure is applied to collapse the button. The cap is adapted to be attached on top of a container, for example, to screw onto a bottle neck, so that when the membrane is pierced contents in the chamber may mix with contents in the container.

The cap may also comprise a flip top or an overcap. For example, a single piece may comprise the collapsible button and a flip top connected thereto by a hinge, or a separate overcap may snap or screw onto the piece comprising the collapsible button.

The invention also comprises a packaging unit comprising the cap described above, for example, a bottle or other container having the cap affixed to the neck or opening of the container by means of screw threads, or otherwise. The packaging unit has two compartments to hold contents, one in the cap chamber and the other in the container, the two compartments are separated by a membrane until the membrane is pierced by the piercing member.

DETAILED DESCRIPTION OF THE INVENTION

Figure 1:
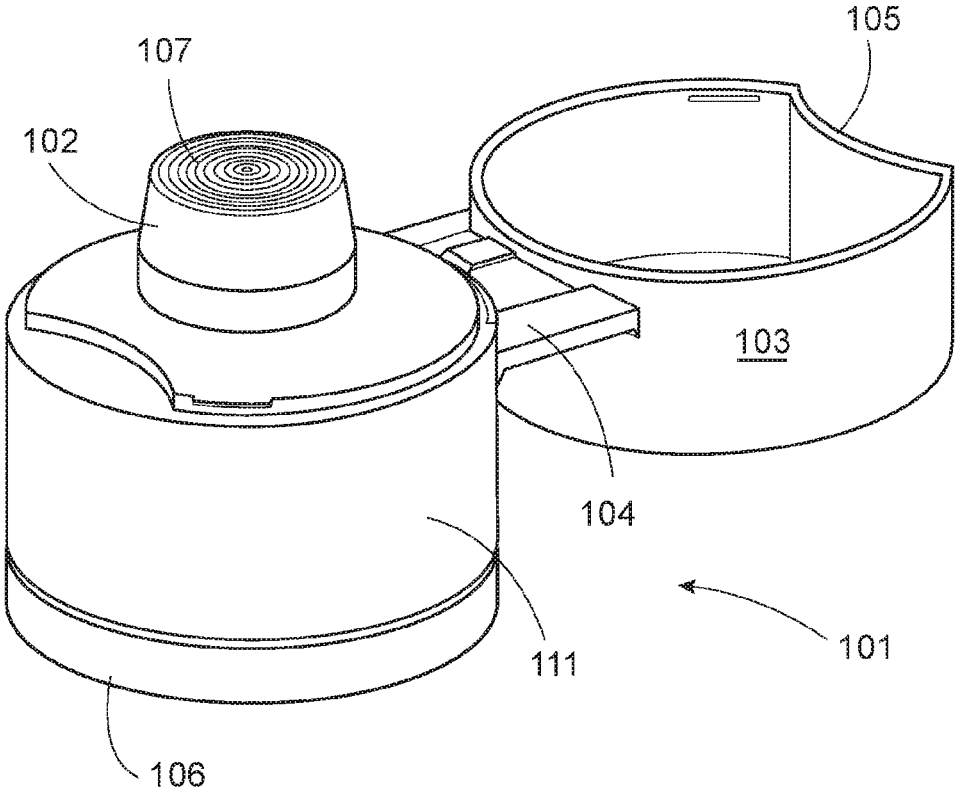
FIG. 1 is a perspective view of an aspect of the invention in which the flip top is in the open position.

In one aspect of this invention, a cap comprises a hollow button, which is configured with creases so that it collapses into the hollow space or chamber underneath the button with relatively little force when depressed. A feature on the underside of the button, such as one or more spikes, blades, punches or other piercing elements, is responsible for breaking a frangible membrane which seals the chamber opening at the bottom of the cap. An advantage of the collapsing button is that there is no need to break a secure seal to push it in and hence the minimum force required to depress the button is not limited by the strength of such a seal.

The creases in the collapsible button may take a variety of forms, and in some aspects they may create undercuts which would normally create difficulty in designing an injection mold. In some aspects, additional moving pieces within the mold are required to achieve the desired form. In one aspect of this invention, the creases are helical with the same screw pitch as the thread in the cap, so that rotation of the mold core removes the cap from both at the same time. The collapsible button may be integral to the body of the cap, or may be assembled to it using equipment and methods known in the art.

Generally, the creases in the collapsible button are thin in section, which might increase its permeability to the external atmosphere and make it easy to press prematurely or damage. Therefore, in some aspects the cap includes a flip top, which may be closed at the point of manufacture of the cap, to protect the button and creases from the external atmosphere and external forces. This supplements the barrier properties of the collapsible button, protecting it and acting as a bearing surface when the cap is inverted for filling of the button-chamber. In alternative aspects, instead of a flip top there may be a top piece or overcap that is snapped, screwed or otherwise affixed onto the cap. In one aspect, a flip top is hingedly attached to the cap. The cap and flip top may comprise a single piece constructed of flexible polymer.

In some aspects, the cap comprises two parts connected by a press fit. The first part comprises the main body enclosing a chamber, having a collapsible button at a top end thereof and an opening to the chamber at a bottom end thereof. The second part comprises a ring having a large central orifice that is blinded by a seal, for example aluminum foil. In one aspect, the foil has a coating on one face which protects the aluminum from the product and is heat-sealable to the material of the ring. It may be inserted into the ring using methods and equipment commonly used to insert induction sealable liners. The coated face is facing the ring, to which it is simultaneously sealed by a conventional technique, such as induction sealing or ultrasonic welding. In these aspects, the second part is pressed into the first part, tightly sealing the foil between the two press fitted parts.

Prior to fitting the two parts together, the chamber inside the cap must be filled with the desired product, component or composition. Since the open end of the chamber is on the bottom, the main body is inverted for filling. After the chamber is filled to the desired level, the ring with the seal is pressed into the main body to seal the chamber dosed so that the contents of the chamber will be retained inside the cap until the foil is broken.

The filling of the product into the inverted cap and the fitting of the two parts together may be conventionally done on machinery typically used to fill hard gelatin capsules, or the like.

Any known material may be used as a membrane to seal or separate the two compartments as long as it provides a sufficient barrier to prevent mixing or permeation of materials across the membrane and does not require excessive force to break through. Typically, a very thin material is used for the membrane, such as paper (for example, wax paper), metal foil, plastic film, or the like. Aluminum foil is quite suitable, as it provides a far higher barrier to permeation than plastic film and is easier to puncture than plastic. The membrane may be coated to reduce potential chemical reactivity with the product and/or permeability to vapors.

In the present invention, the parts of the cap are typically fitted together so that the edges of the membrane are isolated from the product. This is significant when using coated aluminum foil, because aluminum is inclined to dissolve in some products during storage, and interactions between product and packaging are to be avoided, particularly when the product is to be ingested.

In the present invention, the body of the cap fits to the bore of the container that comprises the second chamber. This type of bore seal is well-known in the art, and may be supplemented by further resilient seal features abutting the rim of the container which are known in the art. In addition, the bore seal, being a compression ring, can further secure the parts of the cap together and ensure the seal between them.

In the practice of this invention, it is contemplated that the end user will open the flip top (or remove a top piece or overcap, if any), and press the button to collapse it so as to pierce the membrane and release the contents of the cap into the container. As there is no opening under the flip top or overcap, there is no need to provide it with tamper evidence. The hinge of the flip top may be designed for a single use, and so does not need to be sophisticated in design. In some aspects, the flip top may be reclosed. In one aspect, the flip top, hinge and main body of the cap are a single cast or molded piece.

A piercing element integral with the top of the collapsible button is responsible for piercing the frangible membrane, This may take the form of a simple spike, punch, or blade, but it is important that it does riot block the hole that it produces, so it should be designed to ensure that once the frangible membrane is torn product can flow past the piercing element. For example, its section may be cruciform or cylindrical, it may comprise more than one element, it may be tapered or jagged, or the creases in the collapsible button may be contrived such that the piecing element sweeps a linear, circular, arcuate, or other path as it penetrates the frangible membrane. Any form or design of piercing element known in the art that will pierce the membrane and allow the product to flow past it may be used. In some aspects the collapsible feature of the button may cause it to rotate as it is depressed, with the result that an eccentric piercing element will cut a path across the frangible membrane.

In one aspect, the piercing member comprises at least one first part for piercing the membrane and at least one second part for moving a portion of the pierced membrane to provide an opening through which material may flow.

After the membrane is broken, it is desirable to shake the container as necessary to mix the two components or compositions so that all the contents will be sufficiently mixed together. Those skilled in the art will be able to determine the amount of mixing that may be needed, which will depend on the contents and their intended use. In some aspects of the invention, the product is accessed by removing the whole cap, for example by unscrewing it from the container. In some aspects, the cap has a tamper evident feature, for example a tamper evident neck band. The cap may be attached to the container by any suitable method known in the art, such as being screwed or snapped on as long as there is a tight seal between the container and the cap to prevent the contents from leaking or being contaminated. Any optional tamper evident element known in the art may optionally be used.

It will be appreciated that references herein to the collapse of the button mean that the top or cover wall of the button and the piercing member advance toward the frangible membrane while the creases in the button (whether concentric, helical or otherwise) are squeezed closer together, advancing at least far enough for the piercing member to pierce the membrane and create an opening therethrough. It will also be appreciated that distance the button moves from its initial fully extended position to its fully collapsed position, and the position of the cover wall relative to the rest of the cap in the fully collapsed position, will depend on the exact design of the cap.

The following aspects of the invention are merely illustrative and are not intended to limit the scope of the invention. In these aspects, the parts are made by molding, for example they may be molded plastic. Plastic molding is generally relatively easy and inexpensive; however, other methods and materials may also be used in the practice of this invention.

FIG. 1 illustrates an aspect of a cap 101 according to the invention having a main body 111, a collapsible button 102 and a flip top 103 attached by a hinge 104. The collapsible features in the button are arranged as terraces at progressively changing angles, so that they collapse in sequence. In this aspect, the wall 105 of the flip top is swept inward to facilitate opening without the opening feature requiring any particular orientation with respect to the equipment used to fit the cap, and there is a tamper evident neck band 106. The collapsible button 102 may include a cover wall 107 disposed in opposite relation to the chamber opening 108. In some instances, the cover wall 107 may be substantially planar (see FIGS. 1-3, 6A and 66). In other instances, the cover wall 107 may have a substantially convex or concave profile (see FIGS. 4A, 5A and 5B). Further, the cover wall 107 may define one or more grooves 109 about the exterior surface thereof to allow improved gripping of the collapsible button 102.

Figure 2:
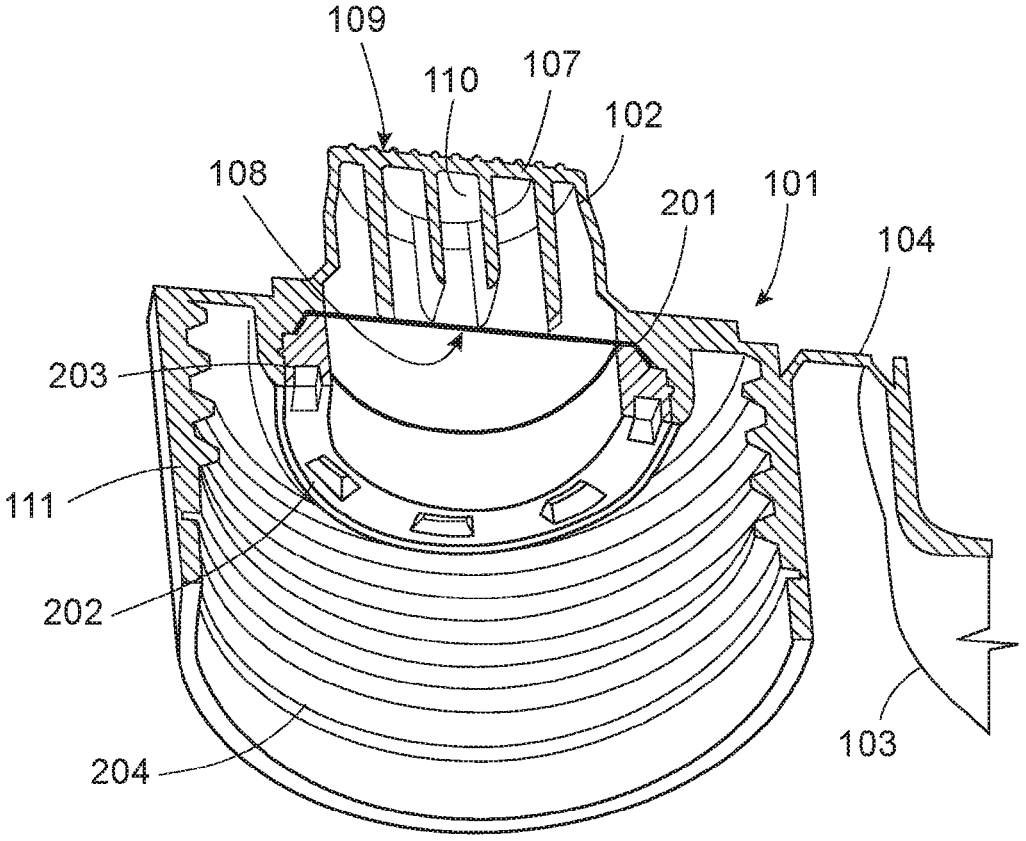
FIG. 2 is a perspective cross-section of an aspect showing a cap ring seal.
Figure 3:
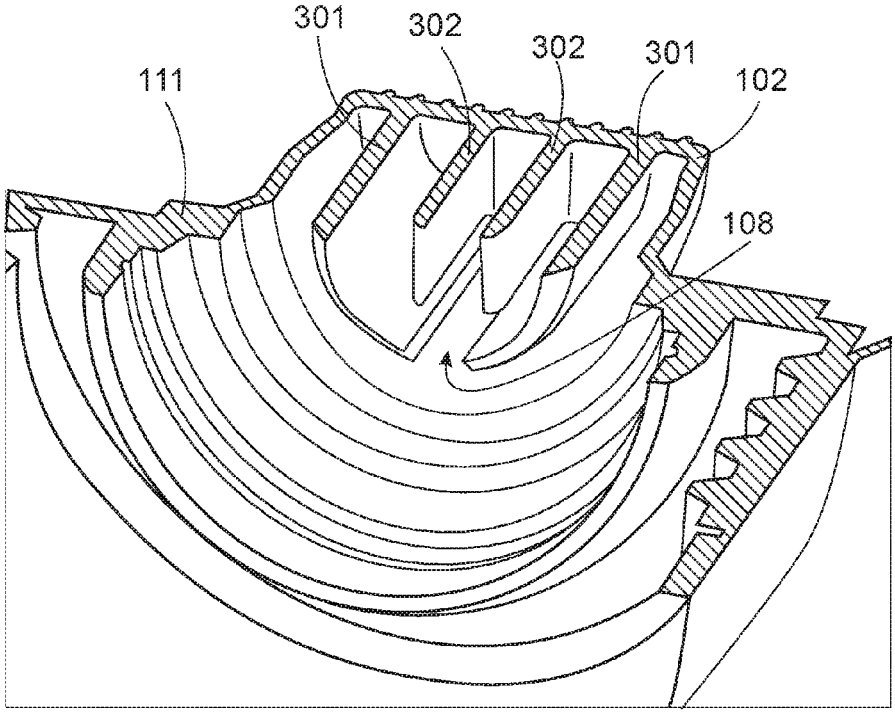
FIG. 3 is a cross-section of an aspect of a piercing element on the underside of a collapsible button.

FIG. 2 illustrates the aspect of FIG. 1 in section. The cap 101 comprises a bore seal 201 having a snap bead 203 and a ring seal 202 which fits into the snap bead 203 to form a sealed chamber inside the cap 101. The cap 101 can be screwed onto the neck of a container 204. As shown in FIG. 3, the underside of the collapsible button 102 (e.g., an inner surface 110) comprises a piercing member having four prong piercing elements; the longer prongs 301 are designed to pierce the membrane and the shorter prongs 302 are designed to fold the torn membrane toward the container 204 so as to create a sufficient opening to facilitate mixing of contents between the chamber and the reservoir of the container 204 to which it is attached.

Figure 4A:
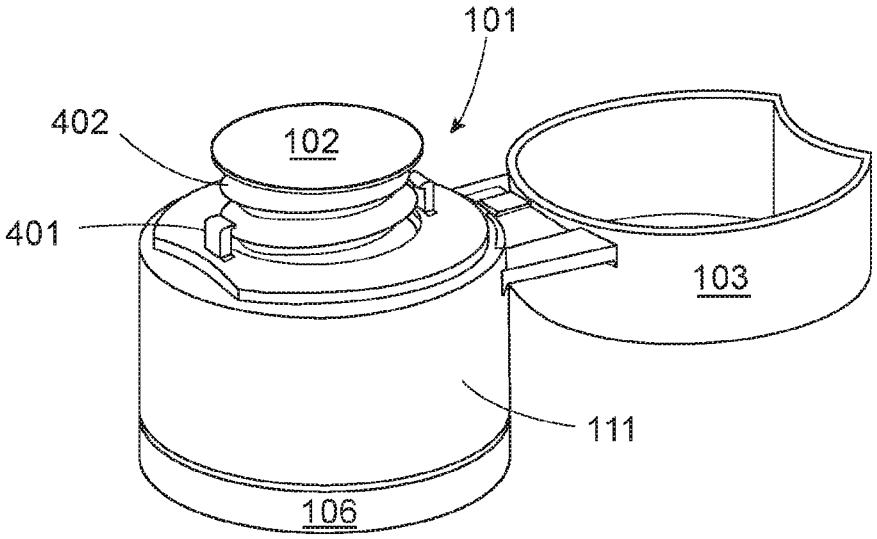
FIG. 4A is a side perspective of an aspect of the invention in which the flip top is in the open position.

FIG. 4A illustrates a collapsible button 102 having a helical thin wall 402. Retaining clips 401 and an enlarged top of the button 102 are also shown, which signal to the user that the button 102 is fully depressed by the retaining clips 401 holding it in that position. That is the cover wall 107 may interact with the retaining clips 401 when the collapsible button 102 is in a fully collapsed position such that the collapsible button 102 is maintained in such a position. This aspect is more complex to produce than the aspect of FIGS. 1-3, because part of the mold needs to split in order to release the enlarged button 102 and retaining clips 401. FIG. 48 illustrates a view of the underside of the cap 101 showing a ring seal, comprising a ring 403 and membrane 405, and the recesses 404 in the ring 403 which snap into the snap bead 203 illustrated in FIG. 2.

Figure 4B:
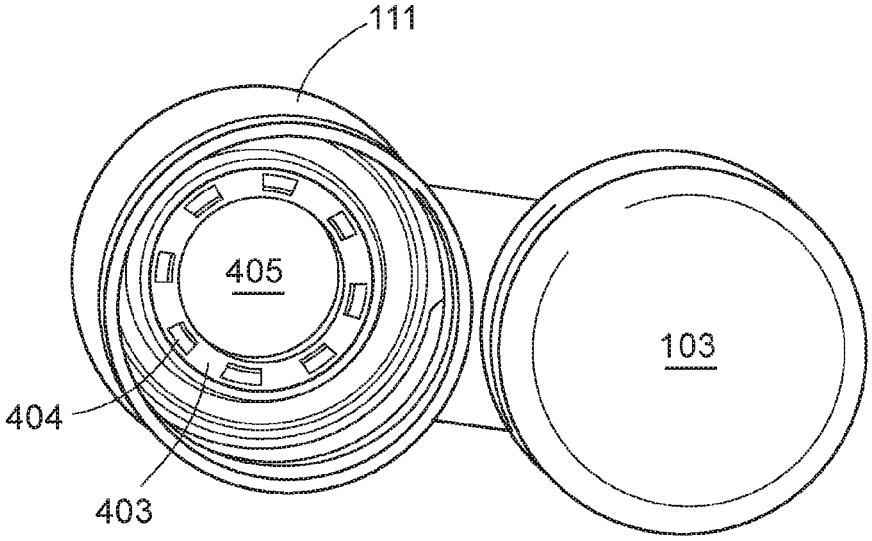
FIG. 4B is a bottom view of an aspect of the cap with sealing ring.
Figure 5A:
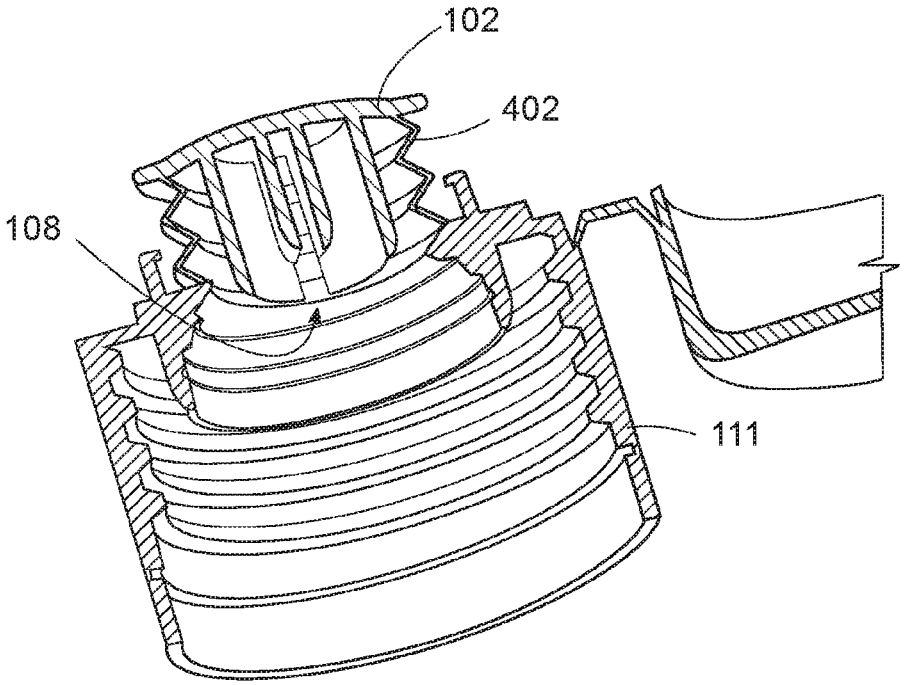
FIG. 5A is a vertical cross-section of an aspect of the invention.
Figure 5B:
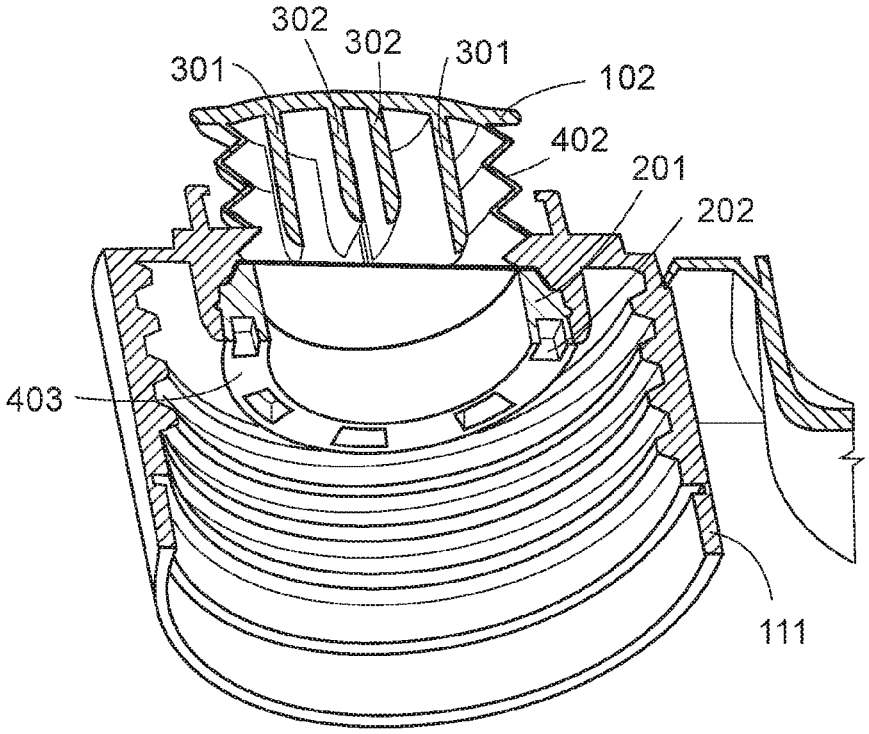
FIG. 5B is a perspective cross-section of an aspect showing a cap ring seal.
Figure 6A:
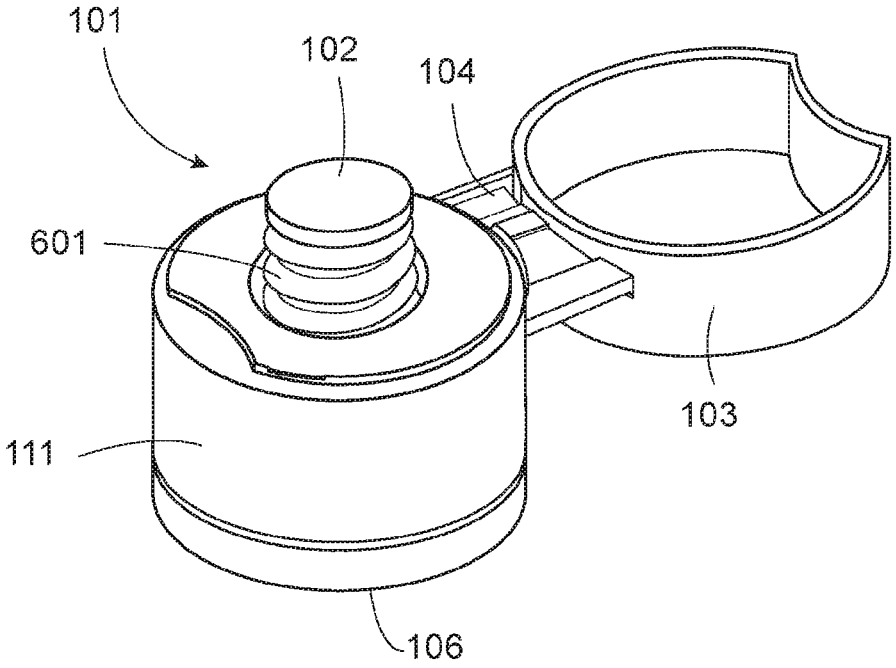
FIG. 6A is a side perspective of an aspect of the invention in which the flip top is in the open position.
Figure 6B:
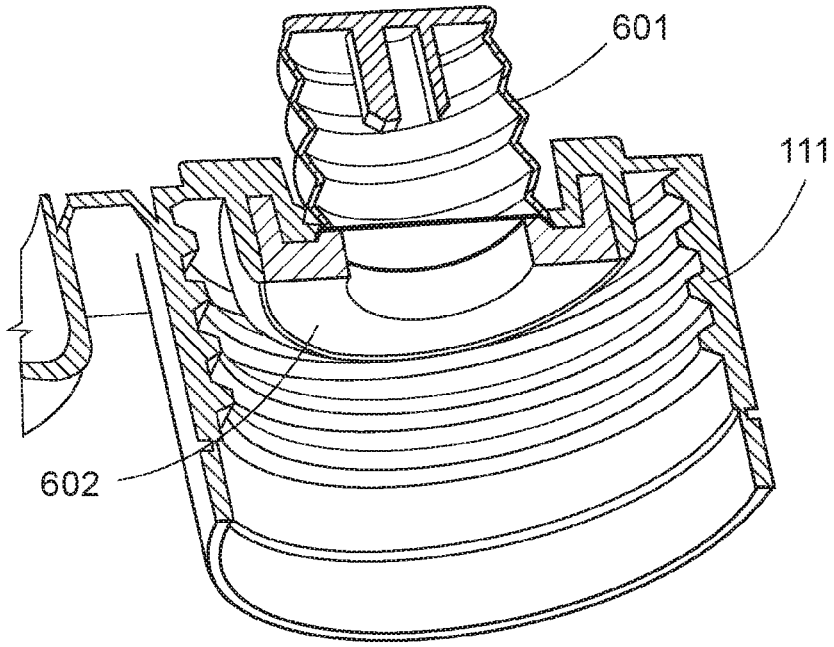
FIG. 6B is a vertical cross-section of an aspect showing a cap ring seal.

FIGS. 5A and 5B illustrate internal sections of the aspect of FIG. 4A FIG. 6A and 6B illustrate an aspect of a cap 101 having a collapsible button 102 in a recessed tapered helical form 601. The collapsible button 102 in this aspect may be collapsed to a greater extent than that shown in FIGS. 4 and 5, but it is somewhat more complex to manufacture, as both parts of the mold need to be rotated. The collapsible button 102 is made slightly conical to facilitate removal from the mold. FIG. 6B illustrates an alternative configuration for the fitting of the ring seal 602.

Figure 7:
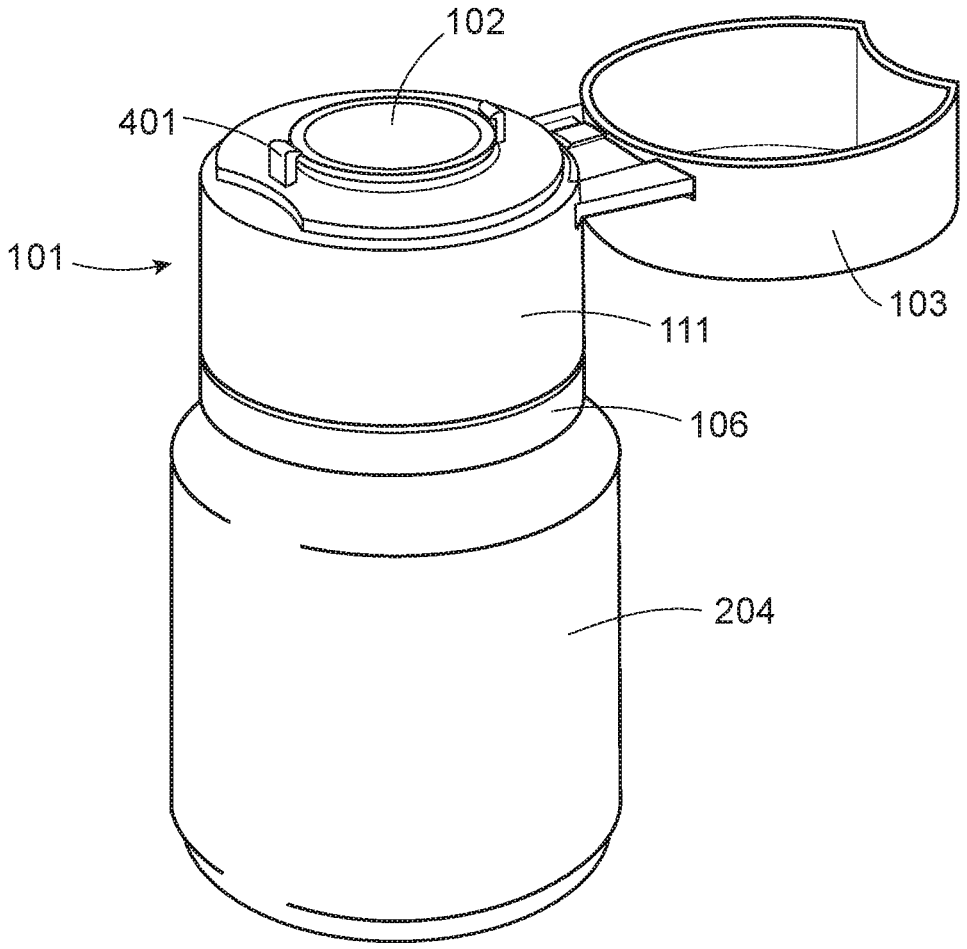
FIG. 7 is a perspective view of an aspect of the invention in which the cap is attached to a container and the button is in the collapsed position.

FIG. 7 illustrates an aspect of the invention in which the cap 101 is attached to a container 204, the flip top 103 is open, and the button 102 is in the collapsed position and is engaged with the retaining dips 401.

Many variations of the present invention not illustrated herein will occur to those skilled in the art. The present invention is not limited to the aspects illustrated and described herein, but encompasses all the subject matter within the scope of the appended claims.

We claim:

1. A cap adapted to be attached to a container, said cap comprising:

a main body having a collapsible button defining an open-ended chamber;

a frangible membrane comprising metal foil operably engaged with the main body so as to cover the open-ended chamber; and a piercing member comprising a spike, blade, punch, or combination thereof, extending from an inner surface of the collapsible button, the piercing member being configured to advance toward and interact with the frangible membrane when the collapsible button is collapsed, so as to pierce the frangible membrane;

wherein the collapsible button comprises a collapsible helical wall with helical creases that converge helically when the button is depressed and having an end sealed by a cover wall having an inner surface and an exterior surface, the helical wall and the cover wall cooperating to form the open-ended chamber, the frangible membrane being disposed opposite the inner surface of the cover wall; and wherein the piercing member comprises a plurality of piercing elements and at least one of the plurality of piercing elements is a first piercing element of a first length joined to the inner surface of the cover wall at a first location for piercing the membrane and at least one of the other of the plurality of piercing elements is a second piercing element of a second length shorter than the first length and being joined to the inner surface of the cover wall at a second location remote from the first location for separating a portion of the pierced membrane and folding said portion into the container to provide an opening through which material is capable of flowing.

2. The cap of claim 1 wherein the main body comprises screw threads so as to be capable of attaching to a container having complementary screw threads.

3. The cap of claim 1 wherein the metal foil comprises aluminum.

4. The cap of claim 1 further comprising an overcap attached to the main body and configured to cover the collapsible button.

5. The cap of claim 1 wherein the cover wall has one of a substantially planar profile and a substantially convex profile.

6. The cap of claim 1 wherein the main body comprises at least one retaining clip configured to interact with and retain the collapsible button in a collapsed position.

7. The cap of claim 1 further comprising a bore seal including the frangible membrane, the bore seal being operably engaged with the main body and configured to position the frangible membrane to cover the open-ended chamber.

8. A packaging unit comprising a cap according to claim 1 and a container having a reservoir therein, wherein the cap is securely attached to an open end of the container to seal the reservoir and wherein the frangible membrane of the cap separates the chamber from the reservoir.

9. The cap of claim 1 wherein the helical wall tapers inwardly while extending toward the cover wall such that the collapsible button has a conical, recessed tapered helical form.

10. A cap adapted to be attached to a container, said cap comprising:

a main body having a collapsible button defining an open-ended chamber;

a frangible membrane operably engaged with the main body so as to cover the open-ended chamber; and a piercing member extending from an inner surface of the collapsible button, the piercing member being configured to advance toward and interact with the frangible membrane when the collapsible button is collapsed, so as to pierce the frangible membrane;

wherein the collapsible button comprises a collapsible helical wall with helical creases that converge helically when the button is depressed and having an end sealed by a cover wall having an inner surface and an exterior surface, the helical wall and the cover wall cooperating to form the open-ended chamber, the frangible membrane being disposed opposite the inner surface of the cover wall;

a bore seal including the frangible membrane, the bore seal being operably engaged with the main body and configured to position the frangible membrane to cover the open-ended chamber; and wherein the bore seal comprises a ring seal and a snap bead, the ring seal and the snap bead cooperating with the frangible membrane to seal the open-ended chamber.

11. A cap adapted to be attached to a container, said cap comprising:

a main body having a collapsible button defining an open-ended chamber;

a frangible membrane operably engaged with the main body so as to cover the open-ended chamber; and a piercing member extending from an inner surface of the collapsible button, the piercing member being configured to advance toward and interact with the frangible membrane when the collapsible button is collapsed, so as to pierce the frangible membrane;

wherein the collapsible button comprises a collapsible side wall and an upper end sealed by a cover wall having an inner surface and an exterior surface, the side wall and the cover wall cooperating to form the open-ended chamber, the frangible membrane being disposed opposite the inner surface of the cover wall;

wherein the main body comprises at least one retaining clip configured to retain the collapsible button in a collapsed position; and wherein the at least one retaining clip comprises L-shaped clips mounted on a lateral surface of the main body adjacent to the collapsible button, each of the L-shaped clips comprising a first leg protruding upwardly from the lateral surface of the main body and a second leg connected to the first leg and protruding inwardly from the first leg toward the collapsible button so as to overlap a periphery of the cover wall of the collapsible button such that the cover wall and L-shaped clip interact to retain the collapsible button in the collapsed position.

12. The cap of claim 11 wherein the L-shaped clips are spaced apart along the periphery of the cover wall of the collapsible button.

13. The cap of claim 12 wherein the L-shaped clips comprise a pair of L-shaped clips located in opposing locations along the periphery of the cover wall of the collapsible button.

* * * * *